US008028769B2

(12) United States Patent
Pessier et al.

(10) Patent No.: US 8,028,769 B2
(45) Date of Patent: Oct. 4, 2011

(54) REAMER WITH STABILIZERS FOR USE IN A WELLBORE

(75) Inventors: Rudolf Carl Pessier, Galveston, TX (US); Robert J. Buske, The Woodlands, TX (US); James Overstreet, Tomball, TX (US)

(73) Assignee: Baker Hughes Incorporated, Houston, TX (US)

( * ) Notice: Subject to any disclaimer, the term of this patent is extended or adjusted under 35 U.S.C. 154(b) by 71 days.

(21) Appl. No.: 12/341,263

(22) Filed: Dec. 22, 2008

(65) Prior Publication Data

US 2009/0166093 A1 Jul. 2, 2009

Related U.S. Application Data

(60) Provisional application No. 61/016,209, filed on Dec. 21, 2007.

(51) Int. Cl.

| | |
|---|---|
| ***E21B 10/30*** | (2006.01) |
| ***E21B 10/08*** | (2006.01) |
| ***E21B 10/28*** | (2006.01) |
| ***E21B 10/26*** | (2006.01) |

(52) U.S. Cl. ..... 175/335; 175/344; 175/334

(58) Field of Classification Search ..... 175/327, 175/331, 334, 344, 385, 399, 406, 57, 356, 175/355

See application file for complete search history.

(56) References Cited

U.S. PATENT DOCUMENTS

| | | | | |
|---|---|---|---|---|
| 3,977,481 | A | 8/1976 | Fisk et al. | |
| 4,071,098 | A | 1/1978 | Dively et al. | |
| 5,052,503 | A | 10/1991 | Lof | |
| 5,289,889 | A * | 3/1994 | Gearhart et al. | 175/325.5 |
| 5,560,440 | A | 10/1996 | Tibbitts | |
| 5,941,323 | A | 8/1999 | Warren | |
| 6,116,357 | A * | 9/2000 | Wagoner et al. | 175/228 |
| 6,386,298 | B1 | 5/2002 | Smith et al. | |
| 6,568,492 | B2 | 5/2003 | Thigpen et al. | |
| 6,609,580 | B2 | 8/2003 | Beaton | |
| 6,729,418 | B2 | 5/2004 | Cariveau et al. | |
| 6,745,858 | B1 | 6/2004 | Estes | |
| 6,827,161 | B2 | 12/2004 | Singh et al. | |
| 6,902,014 | B1 | 6/2005 | Estes | |
| 6,959,774 | B2 | 11/2005 | Nackerud | |
| 7,066,288 | B2 | 6/2006 | Van Klompenburg et al. | |

(Continued)

FOREIGN PATENT DOCUMENTS

WO WO 02/31313 * 4/2002

OTHER PUBLICATIONS

International Search Report and Written Opinion, Application No. PCT/US2008/087979, dated Aug. 26, 2009.

*Primary Examiner* — Thomas Beach
*Assistant Examiner* — James G. Sayre
(74) *Attorney, Agent, or Firm* — Bracewell & Giuliani LLP

(57) ABSTRACT

A reamer bit for use in earth boring operations comprising a body, cutter mounts having rolling cutters on the bit body, and stabilizers pads on the body placed between adjacent cutter mounts. The reamer may further include a pilot bit on a drill pipe extending downward from the reamer body. The reamer bit outer periphery with its stabilizers and bit body has a radial profile approximating a circle thereby reducing dynamic perturbations during drilling operations.

17 Claims, 3 Drawing Sheets

U.S. PATENT DOCUMENTS

| | | | | |
|---|---|---|---|---|
| 7,137,460 | B2 | 11/2006 | Slaughter, Jr. et al. | |
| 7,152,702 | B1 | 12/2006 | Bhome et al. | |
| 2001/0045306 | A1* | 11/2001 | Fielder et al. | 175/385 |
| 2002/0020565 | A1 | 2/2002 | Hart et al. | |
| 2004/0074672 | A1 | 4/2004 | Rives | |
| 2005/0252693 | A1 | 11/2005 | Brannstrom | |
| 2006/0054357 | A1* | 3/2006 | Centala et al. | 175/57 |
| 2006/0096788 | A1 | 5/2006 | Virtanen | |
| 2006/0260848 | A1* | 11/2006 | Fyfe | 175/344 |
| 2007/0095577 | A1* | 5/2007 | Griffo et al. | 175/374 |
| 2007/0175664 | A1 | 8/2007 | Holmgren | |
| 2009/0120692 | A1* | 5/2009 | Kembaiyan et al. | 175/385 |

* cited by examiner

REAMER WITH STABILIZERS FOR USE IN A WELLBORE

RELATED APPLICATIONS

This application claims priority to and the benefit of co-pending U.S. Provisional Application Ser. No. 61/016,209, filed Dec. 21, 2007, the full disclosure of which is hereby incorporated by reference herein.

BACKGROUND

1. Field of Invention

This disclosure relates to earth boring reamer bits, and particularly to reamer bits having stabilizers disposed on the bit body.

2. Description of Prior Art

Drill bits used in drilling of subterranean well bores typically comprise drag bits and roller cone bits. Roller cone bits typically comprise a body having legs extending downward and a head bearing extending from the leg towards the axis of the bit body. Frusto-conically shaped roller cones are rotatably mounted on each of these journals and are included with cutting teeth on the outer surface of these cones. As the bit rotates, the cones rotate to cause the cutting elements to disintegrate the earth formation.

In some situations a pilot reamer drilling system is employed where two or more bits are combined on a single drill string at different vertical positions. The lower bit of the pilot reamer drilling system, which is commonly referred to as a pilot bit, creates a pilot hole. The upper bit, which follows the lower bit in the drilling process, enlarges the hole diameter over that created by the pilot bit. The bit enlarging the hole diameter is referred to as a reamer bit. Typically the pilot bit comprises a conventional earth boring bit, i.e. either a roller cone bit or a drag bit. The reamer bit usually employs roller cone bits as cutting members modified for attachment to the reamer bit body. Pilot reamer drilling systems are used for drilling large diameter wellbores or surface holes which require enhanced stabilization.

SUMMARY OF INVENTION

The disclosure herein includes a reamer bit for downhole earth boring operations comprising, a reamer body having an axis, rolling cutters mounted on the body, and stabilizers disposed between adjacent cutters. Pockets may be provided on the body outer diameter formed to receive the stabilizers and cutter mounts therein. A pilot bit is affixed to the drill shaft extending from the body's lower end. The pilot bit can be a roller cone bit or a drag bit. An updrill surface may be included formed on the upper portion of the cutter mounts and the stabilizer pads. The combined radial profile of the bit legs and the stabilizer pads can approximate a circular shape.

In an alternative embodiment, the present disclosure includes a pilot reamer apparatus for earth boring use comprising a reamer body having an upper end and a lower end, an axis extending through the upper and lower ends, an outer periphery circumscribing the axis, and pockets formed in the outer periphery, a drill string attachment on the body upper end, a drill pipe segment on the body lower end, a pilot bit affixed to the drill pipe terminal end, cutter mounts on the body outer periphery extending downwardly, rolling cutters rotatingly affixed to the mounts, and stabilizer pads affixed to the reamer body outer periphery disposed between adjacent bit legs.

BRIEF DESCRIPTION OF DRAWINGS

Some of the features and benefits of the present invention having been stated, others will become apparent as the description proceeds when taken in conjunction with the accompanying drawings, in which.

Figure 1:
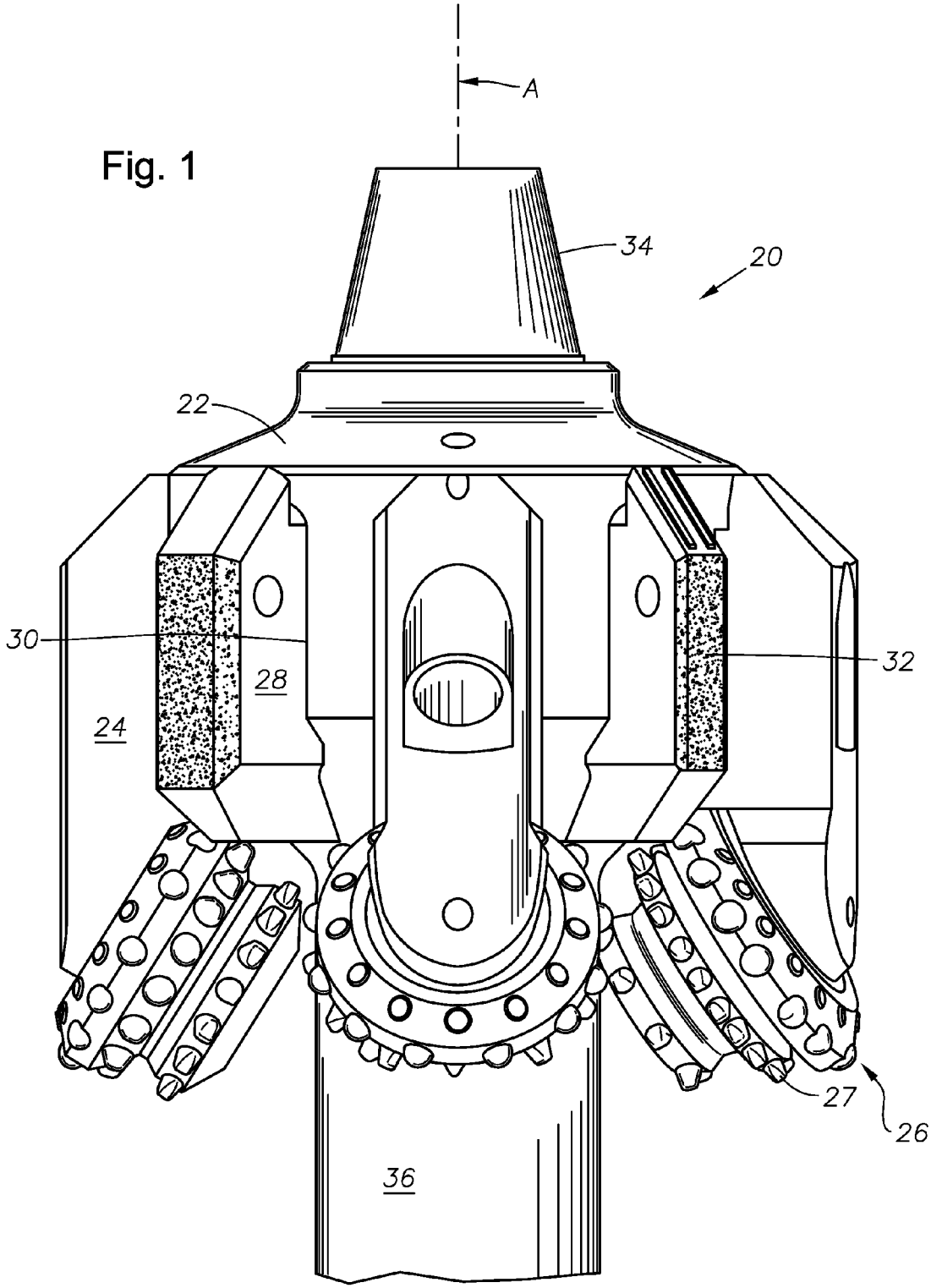
FIG. 1 is a side view of a reamer bit body with rolling cutters and stabilizer pads.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The present invention will now be described more fully hereinafter with reference to the accompanying drawings in which embodiments of the invention are shown. This invention may, however, be embodied in many different forms and should not be construed as limited to the illustrated embodiments set forth herein; rather, these embodiments are provided so that this disclosure will be thorough and complete, and will fully convey the scope of the invention to those skilled in the art. Like numbers refer to like elements throughout.

It is to be understood that the invention is not limited to the exact details of construction, operation, exact materials, or embodiments shown and described, as modifications and equivalents will be apparent to one skilled in the art. In the drawings and specification, there have been disclosed illustrative embodiments of the invention and, although specific terms are employed, they are used in a generic and descriptive sense only and not for the purpose of limitation. Accordingly, the invention is therefore to be limited only by the scope of the appended claims.

FIG. 1 provides in a side view an example of a reamer 20 comprising a generally cylindrical body 22 having cutter mounts 24 and stabilizer pads 28 affixed on its outer lateral periphery. The stabilizer pads 28 are disposed between adjacently located cutter mounts 24. In the embodiment shown, the cutter mounts 24 and the stabilizer pads 28 are elongate members wherein their lengthwise axes are substantially aligned with the axis A of the bit body 22. Each cutter mount 24 comprises a bearing shaft (not shown) extending from the outer end of the mount 24 in a generally downward direction in towards the axis A. Cutters 26 are rotatably mounted on each shaft and have rows of inserts or teeth 27 formed in a generally circumferential arrangement on the cutters outer surface. The inserts 27 also referred to as cutting elements may be secured to the cutter shell in apertures of selected dimensions, integrally formed, such as by machining (teeth), or later attached after forming the cutter 26 and affixed by welding and/or brazing.

The reamer 20 further includes a connector 34 on its upper end, wherein the connector is generally concentrically placed around the axis A of the cylindrical body 22. The connector 34 includes threads (not shown) for connection to an associated drill string. A shaft 36 is shown at the bottom end of cylindrical body 22 and extends downward for attachment of a pilot drill bit. Pockets 30 may be formed on the lateral periphery of the body 22 configured to receive cutter mounts 24 and stabilizer pads 28. The bit legs and stabilizer pads 28 may be welded or brazed to the body 22. Furthermore, hard facing 32 may be included on the outer surface of the stabilizer pads 28. Additionally, the upper portion of the stabilizer pads 28 and cutter mounts 24 may be included with ridges 33, inserts, or other raised elements for providing an updrilling function when drawing the reamer 20 upward within the well bore.

Figure 2:
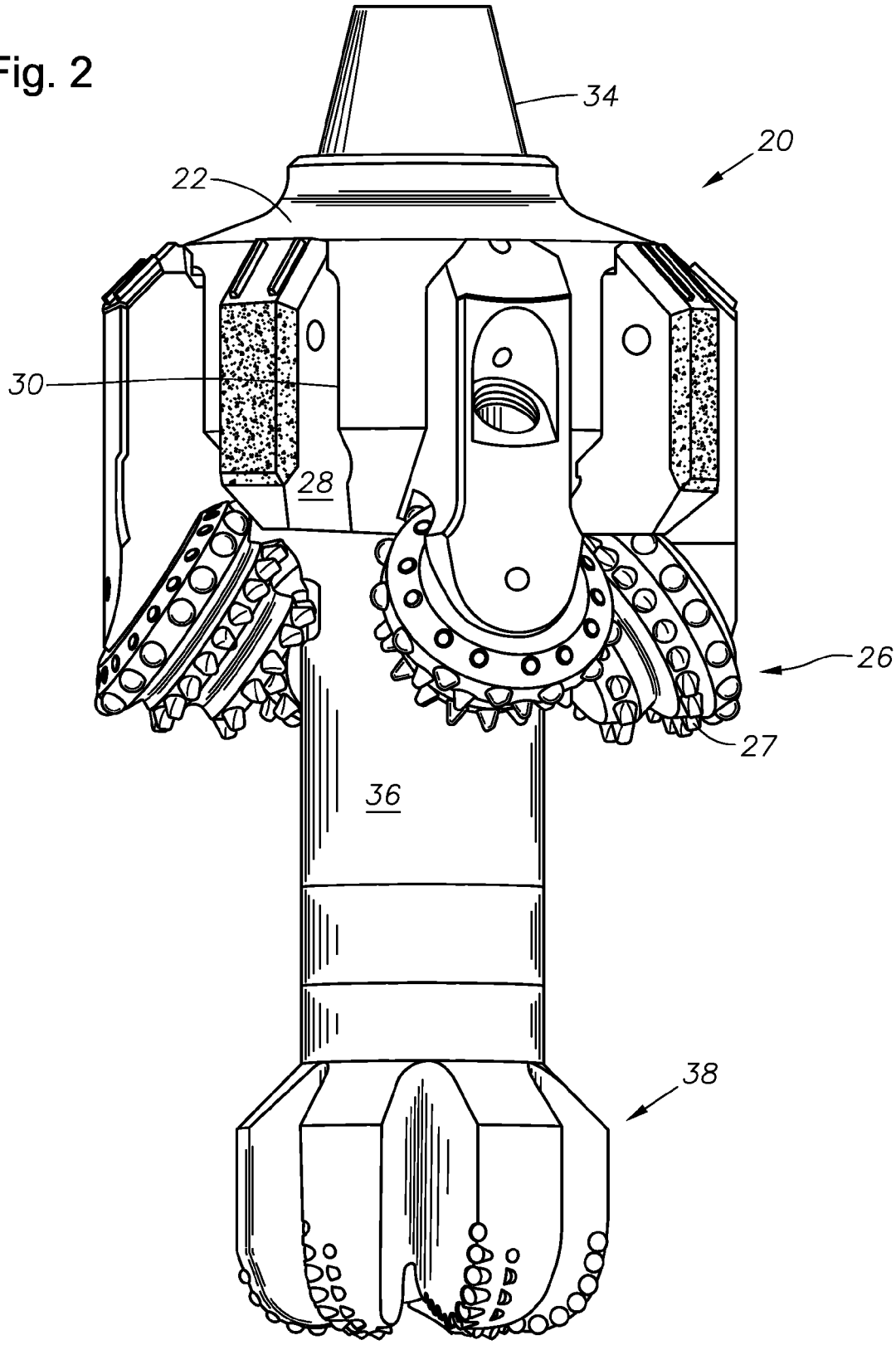
FIG. 2 is a perspective view of a reamer bit with attached pilot bit.

FIG. 2 provides a perspective view of the reamer 20 combined with the shaft 36 and a pilot bit 38 fixed to the lower terminal end of the shaft 36 thereby forming a pilot reamer assembly 18. The assembly 18 may be attachable to the lower end of a drill string (not shown) and attached thereto by the connector 34. While the pilot bit 38 is illustrated as a drag bit, it may also comprise a roller cone bit. The pilot reamer system 18 of FIG. 2 may be used to drill large diameter boreholes in which conventional drill bits are less stable due to the radial distance between adjacent cutters.

Figure 3:
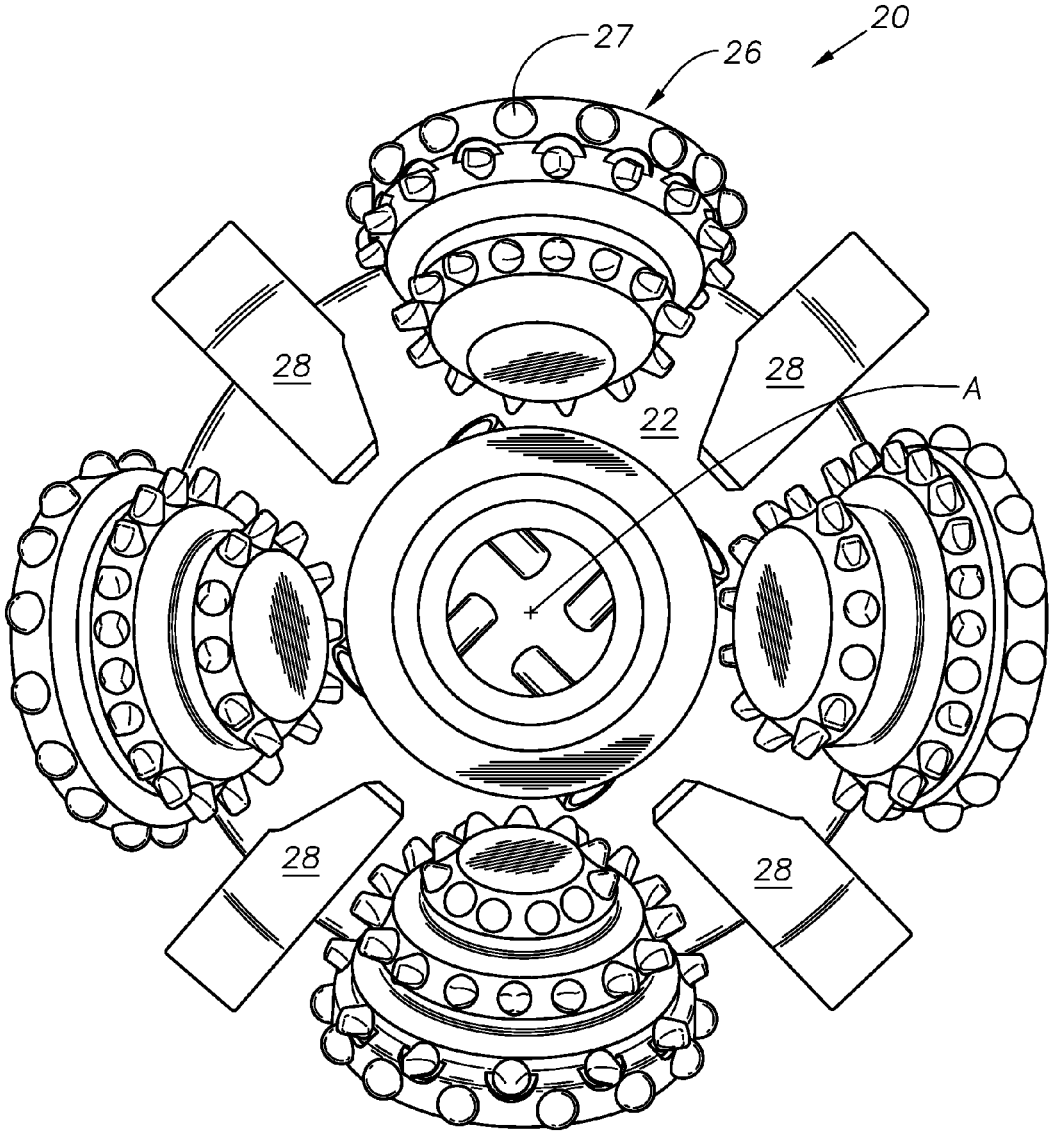
FIG. 3 is an upward looking view of a reamer bit in accordance with the present disclosure having stabilizers.

FIG. 3 is an upward-looking view of a bottom of a reamer 20 embodiment. In this view the stabilizer pads 28 extend downward between adjacently positioned cutters 26 of corresponding mounts 24. The stabilizer pads 28 enhance reamer 20 outer circumference surface continuity by providing additional borehole diameter contact points on the reamer outer surface. Enhancing the reamer 20 outer circumference surface continuity aligns the bit in the wellbore and limits the lateral displacements and distributes the side loads more evenly when a cutter 26 tangentially strikes the wellbore wall. Thus better alignment promotes rotation about the center of the reamer and prevents dynamic dysfunctions such as bit whirl.

To help maintain a continuity of surface, the stabilizer pads in one embodiment may have an outer profile or curvature substantially the same as the outer profile of the cutter mounts. The result of this can be seen in FIGS. 2 and 3 wherein the reamer 20 has a generally circular configuration due to the presence of the stabilizers 28. The circular configuration is also attributed to the pad outer surface having large diameter curvature and the stabilizer pads 28 having an outer radial profile similar to the cutter mounts 24 outer radial profile. This similarity in outer radial profile approximates a full circle, thus limiting open spaces 31 between adjacent cutter mounts 24 that may produce lateral displacements and high side forces during reaming operations.

The stabilizer pads 28 can have any shape or configuration suitable for smoothing bit operations and total contact area. This includes an elongate member where the elongate axis is parallel to the body axis, perpendicular to the body axis, or oblique to the body axis. Moreover, the reamer 20 profile having stabilizer pads 28 is not limited to a substantially circular shape, but can be any shape, such as one having multiple sides where a side is defined as the area between each adjacent stabilizer pad 28 and cutter mount 24.

The invention claimed is:

1. A reamer bit for downhole earth boring operations comprising:

a reamer body having an axis and an exterior cylindrical surface;

cutter mounts attached to and spaced around the cylindrical surface of the body, each of the mounts extending outward from the cylindrical surface of the body, each of the mounts having an upper end that inclines relative to the axis, and each of the mounts having an outer surface;

a cutter rotatably attached to a lower end of each mount;

a plurality of stabilizer pads mounted to the cylindrical surface of the body, each of the stabilizer pads having an outer surface spaced substantially a same distance from the axis as the outer surface of each of the mounts, and each of the stabilizer pads having an upper end that inclines at a same angle as the upper ends of the mounts and is located at the same elevation on the body as the upper ends of the mounts;

each of cutter mounts having side walls and each of the stabilizer pads having side walls that join the cylindrical surface of the body, each of the side walls of each of the stabilizer pads being opposed to and circumferentially spaced from one of the side walls of one of the cutter mounts, defining an open segment of the cylindrical surface between each of the side walls;

a drill shaft extending from a lower end of the body; and a pilot bit affixed to a lower end of the drill shaft.

2. The reamer bit according to claim 1, wherein:

the body has a conical lower shoulder joining and extending downward from the cylindrical surface; and each of the stabilizer pads has a.lower portion that joins the lower shoulder.

3. The reamer bit according to claim 1, wherein:

each of the stabilizer pads has a lower end that is located at a higher elevation on the bit body that a cutter axis of each of the cutters.

4. The reamer bit according to claim 1, further comprising a plurality of pockets formed in the cylindrical surface of the body, each of the pockets located between adjacent ones of the cutter mounts; and each of the stabilizer pads having an inner surface that is received within one of the pockets.

5. The reamer bit according to claim 4, wherein:

the body of the bit has a conical shoulder extending upward and inward from a junction with the cylindrical surface; and each of the pockets has an upper end spaced below the junction.

6. The reamer bit according to claim 1, further comprising raised elements on each of the upper ends of the stabilizer pads for updrilling.

7. The reamer bit according to claim 1, further comprising hardfacing on the outer surface of each of the stabilizer pads.

8. The reamer bit according to claim 1, wherein:

the body has a conical lower shoulder joining and extending downward from the cylindrical surface; and each of the stabilizer pads has a lower portion that joins the lower shoulder and extends below a junction of the conical lower shoulder and the cylindrical surface.

9. The reamer bit according to claim 1, wherein the distance from the outer surface of each of the stabilizer pads to the axis is constant from the upper end to a lower end of each of the stabilizer pads.

10. A pilot reamer apparatus for earth boring use comprising:

a reamer body having an upper end and a lower end, an axis extending through the upper and lower ends, an outer periphery circumscribing the axis, and pockets formed in the outer periphery;

a drill string attachment on the body upper end;

a drill pipe segment on the body lower end;

a pilot bit affixed to a lower end of the drill pipe segment;

cutter mounts on the body outer periphery, each of the cutter mounts having an upper end that joins the body outer periphery and inclines relative to the axis and an outer surface radially spaced from the axis;

cutters rotatingly affixed to the cutter mounts;

stabilizer pads affixed to the reamer body outer periphery disposed between adjacent cutter mounts, each of the stabilizer pads having an upper end that joins the body outer periphery at a same elevation as the upper ends of the cutter mounts and inclines relative to the axis at the same angle as the upper ends of the cutter mounts, each of the stabilizer pads having a lower end that is located at a higher elevation that a lowermost point on any of the cutters, and each of the stabilizer pads having an outer surface radially spaced from the axis a same distance as the outer surfaces of the cutter mounts; and each of cutter mounts having side walls and each of the stabilizer pads having side walls that join the cylindrical surface of the body, each of the side walls of each of the stabilizer pads being opposed to and circumferentially spaced from one of the side walls of one of the cutter mounts, defining an open segment of the cylindrical surface between each of the side walls.

11. The pilot reamer apparatus of claim 10 further comprising a drill string affixed to the drill string attachment.

12. The pilot reamer apparatus of claim 10 wherein:

the body has a conical lower shoulder joining and extending downward from the cylindrical surface; and each of the stabilizer pads has a lower portion that joins the lower shoulder and extends below a junction of the conical lower shoulder and the cylindrical surface.

13. The pilot reamer apparatus of claim 10 further comprising hardfacing on the outer surfaces of the stabilizer pads.

14. The pilot reamer apparatus of claim 10, wherein:

the bit body has conical upper shoulder and an exterior cylindrical surface extending downward from the upper shoulder; and the upper ends of the mounts and the upper ends of the stabilizer pads join the upper shoulder.

15. The pilot reamer apparatus of claim 10 wherein: the bit body has conical upper shoulder and an exterior cylindrical surface extending downward from file upper shoulder; and a pocket is formed in the cylindrical surface between adjacent cutter mounts, each of the pockets having an upper end below a junction of the upper shoulder and the cylindrical surface, and each of the pockets receiving one of the stabilizer pads.

16. The pilot reamer apparatus of claim 10, wherein a longitudinal cross section of each of the stabilizer pads is substantially rectangular.

17. The pilot reamer apparatus of claim 10 further comprising an updrill cutting feature formed on the upper ends of the stabilizer pads.

* * * * *

UNITED STATES PATENT AND TRADEMARK OFFICE

CERTIFICATE OF CORRECTION

PATENT NO. : 8,028,769 B2
APPLICATION NO. : 12/341263
DATED : October 4, 2011
INVENTOR(S) : Rudolf Carl Pessier et al.

It is certified that error appears in the above-identified patent and that said Letters Patent is hereby corrected as shown below:

Column 4, line 21, delete “that” and insert --than--
Column 6, line 11, delete “file” and insert --the--

Signed and Sealed this
Fourteenth Day of February, 2012

David J. Kappos

David J. Kappos
*Director of the United States Patent and Trademark Office*